US009382047B2

(12) United States Patent
Schmidtner et al.

(10) Patent No.: US 9,382,047 B2
(45) Date of Patent: Jul. 5, 2016

(54) MULTIPART COVER MADE OF PAPER MATERIAL AND METHOD FOR PRODUCING A MULTIPART COVER

(71) Applicants: Alois Schmidtner, Hellertown, PA (US); Werner Stahlecker, Goeppingen (DE)

(72) Inventors: Alois Schmidtner, Hellertown, PA (US); Werner Stahlecker, Goeppingen (DE)

(73) Assignee: MICHAEL HOERAUF MASCHINENFABRIK GMBH U. CO. KG, Donzdorf (DE)

( * ) Notice: Subject to any disclaimer, the term of this patent is extended or adjusted under 35 U.S.C. 154(b) by 0 days.

(21) Appl. No.: 13/845,735

(22) Filed: Mar. 18, 2013

(65) Prior Publication Data

US 2013/0334228 A1 Dec. 19, 2013

Related U.S. Application Data

(60) Provisional application No. 61/659,162, filed on Jun. 13, 2012.

(30) Foreign Application Priority Data

Sep. 18, 2012 (DE) ..... 10 2012 216 631

(51) Int. Cl.
*B65D 43/03* (2006.01)
*B65D 43/06* (2006.01)
(Continued)

(52) U.S. Cl.
CPC ..... *B65D 45/32* (2013.01); *B65D 43/0212* (2013.01); *B65D 2543/0075* (2013.01);
(Continued)

(58) Field of Classification Search
CPC ..... B65D 2543/00638; B65D 2543/0075; B65D 2543/00796; B65D 43/32; B65D 43/0212; B65D 2543/00092; B65D 2543/00268; B65D 2543/00537
USPC ..... 220/319, 309.1, 280; 215/323, 326; 206/519, 508
See application file for complete search history.

(56) References Cited

U.S. PATENT DOCUMENTS 1,367,812 A * 2/1921 Hammer ..... 215/323
2,018,006 A * 10/1935 Barnby ..... 215/337
(Continued)

FOREIGN PATENT DOCUMENTS

CN 1201748 A 12/1998
DE 43 37 176 A1 5/1995
(Continued)

OTHER PUBLICATIONS

Search Report of European Patent Office issued in Application No. EP 13167962.3 dated Oct. 24, 2013 with English translation of Categories of Cited Documents (8 pages).
(Continued)

*Primary Examiner* — J. Gregory Pickett
*Assistant Examiner* — Niki M Eloshway
(74) *Attorney, Agent, or Firm* — Flynn, Thiel, Boutell & Tanis, P.C.

(57) ABSTRACT

A multipart cover made of paper material and including a one-piece base body having a cover plate and a circumferential cover collar extending from the cover plate. The cover collar, when placed onto a container to be closed, extends upwards away from the container, and a reinforcement ring connected to the cover collar by means of a peripheral skirt. The reinforcement ring in a region below the cover plate, on a side of the cover plate opposite to the cover collar, includes a peripheral skirt forming a circumferential step along the periphery on a radially interior side of the reinforcement ring, or includes a circumferential bead along the periphery.

14 Claims, 11 Drawing Sheets

(51) Int. Cl.

| | |
|---|---|
| ***B65D 45/32*** | (2006.01) |
| ***B65D 43/02*** | (2006.01) |
| *B65D 43/10* | (2006.01) |

(52) U.S. Cl.

CPC ..... *B65D2543/00092* (2013.01); *B65D 2543/00268* (2013.01); *B65D 2543/00537* (2013.01); *B65D 2543/00638* (2013.01); *B65D 2543/00796* (2013.01)

(56) References Cited

U.S. PATENT DOCUMENTS

| | | | | | |
|---|---|---|---|---|---|
| 2,808,168 | A | * | 10/1957 | Majer | 215/316 |
| 3,104,045 | A | * | 9/1963 | Sheninger et al. | 229/125.26 |
| 3,447,734 | A | * | 6/1969 | Wilcox | 206/515 |
| 4,102,454 | A | * | 7/1978 | Karevaara | 206/514 |
| 4,351,472 | A | * | 9/1982 | Eddy | 229/5.6 |
| 4,360,119 | A | * | 11/1982 | Olivo | 220/522 |
| 4,364,476 | A | * | 12/1982 | Weller et al. | 206/508 |
| 5,960,985 | A | * | 10/1999 | Barrett | 220/780 |
| 6,325,213 | B1 | * | 12/2001 | Landis, II | 206/519 |
| 6,454,118 | B1 | * | 9/2002 | D'Amato | 220/380 |
| 6,685,049 | B1 | * | 2/2004 | Paladino | 220/781 |
| 2010/0176130 | A1 | | 7/2010 | Kim | |

FOREIGN PATENT DOCUMENTS

| | | | |
|---|---|---|---|
| EP | 0 639 509 | A1 | 2/1995 |
| WO | WO 99/15421 | | 4/1999 |
| WO | WO 2008/104019 | A1 | 9/2008 |

OTHER PUBLICATIONS

Office Action of Chinese Patent Office issued in Application No. 201310232696.6 dated Mar. 2, 2016 (12 pages).

* cited by examiner

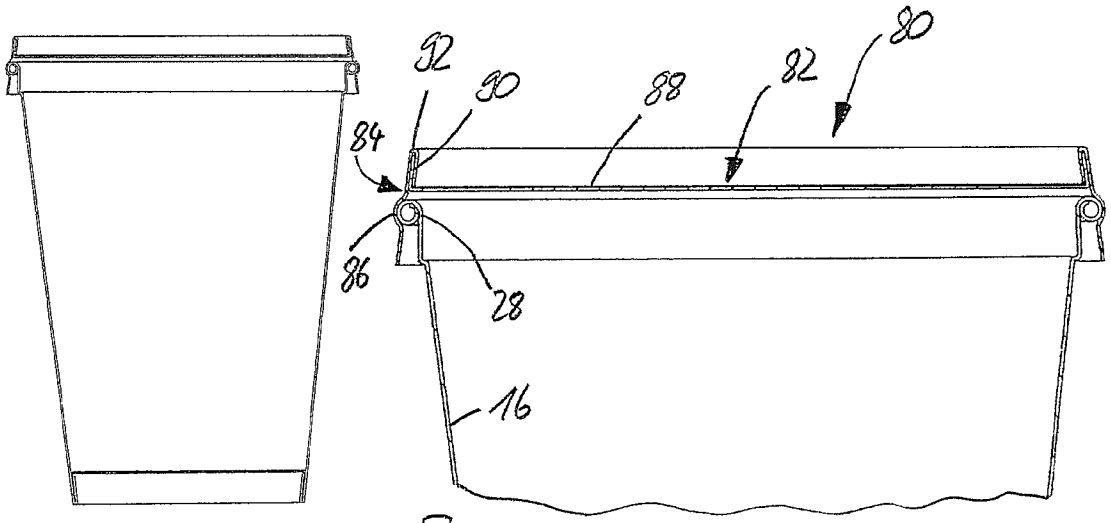
Fig. 23
Fig. 22
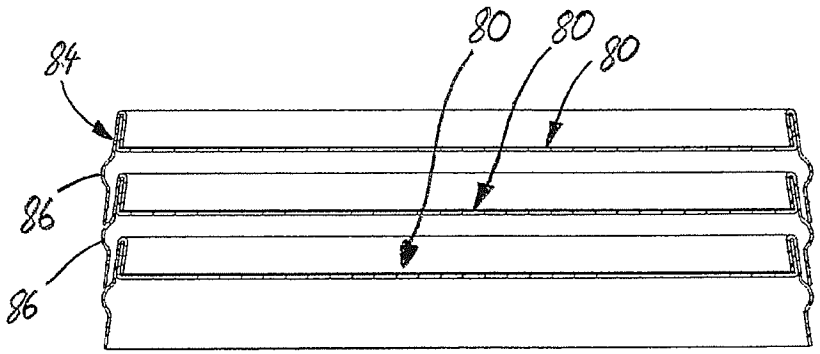
Fig. 25
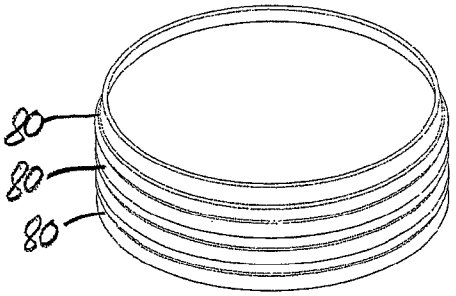
Fig. 24
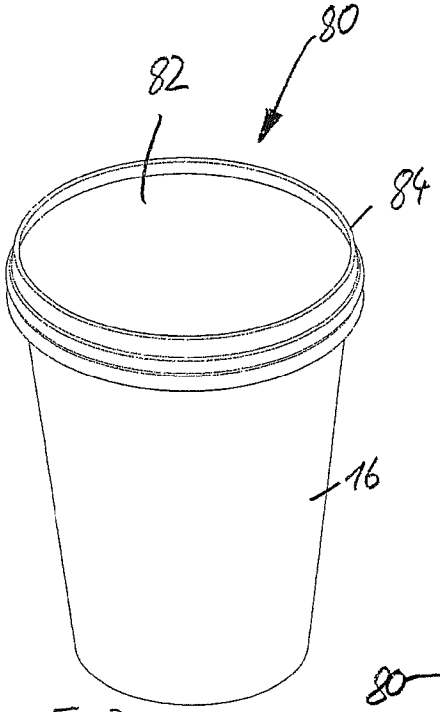
Fig. 21

MULTIPART COVER MADE OF PAPER MATERIAL AND METHOD FOR PRODUCING A MULTIPART COVER

CROSS REFERENCE TO RELATED APPLICATION

This claims the benefit of U.S. Provisional Application No. 61/659,162, filed Jun. 13, 2012.

BACKGROUND OF THE INVENTION

The invention relates to a multipart cover made of paper material comprising a one-piece base body including a cover plate and a circumferential cover collar extending from the cover plate, wherein the cover collar, in a condition placed onto a container to be closed, extends upwards away from the container, and a reinforcement ring connected to the cover collar by means of a peripheral shroud or skirt. The invention also relates to a method for producing a multipart cover made of paper material.

The aim of the invention is to provide an improved multipart cover made of paper material and an improved method for producing a multipart cover made of paper material.

According to the invention a multipart cover made of paper material is provided, comprising a one-piece base body which includes a cover plate and a circumferential cover collar extending from the cover plate, wherein the cover collar, in a condition placed onto a container to be closed, extends upwards away from the container, and comprising a reinforcement ring connected to the cover collar by means of a peripheral skirt, wherein the reinforcement ring in a region below the cover plate, that is, on a side of the cover plate opposite to the cover collar, includes a peripheral skirt forming a circumferential step or shoulder along the periphery on a radially interior side of the reinforcement ring, or a circumferential bead along the periphery.

The invention provides a multipart cover made of paper material that, on the one hand, has a simple structure, and on the other hand, can be made in a stable configuration. A peripheral skirt forms a circumferential step along the periphery adapted to be used for hooked engagement of the cover on a lip rim or a lip roll of a container to be closed. Thereby the cover sits securely on a container to be closed. A skirt is meant to be a portion of the reinforcement ring which is folded over by 180° and pressed. Advantageously, the peripheral skirt is folded over by 180° below the cover plate and then comes to be placed on the material of the reinforcement ring. Thus, said skirt is merely to obtain a thickening of the reinforcement ring in its lower portion, however, there are not two components connected one to the other. In contrast thereto, the peripheral skirt of the reinforcement ring above the cover plate connects the reinforcement ring to the cover collar of the base body. For this, the reinforcement ring is equally folded over by 180° at the upper end thereof, however, the cover collar is then received between the two material layers of the folded over reinforcement ring. After pressing and adhesive bonding or sealing, as the case may be, the cover collar is fixedly connected to the reinforcement ring.

As an alternative to a peripheral skirt below the cover plate, a circumferential bead along the periphery is provided on the reinforcement ring. Even by means of the circumferential bead, a secure fitting of the cover according to the invention on a lip rim of a container to be closed may be obtained. The lip rim of the container may have, as seen here in cross section, a circular shape or even an oval shape, for example, when the lip rim is flattened. Incidentally, the expression "lip rim" may in general be used to designate an upper, reinforced rim of a container, for example a cup made of synthetic material including an upper, thickened rim.

In this context, paper as well as paper-type materials, e. g. paperboard, pasteboard, cardboard, or the like are considered to be paper materials, even paper material coated by wax or synthetic material on one side or on two sides. The coated surface of the paper material can be adapted to hot sealing.

In a further development of the invention, the bead extends radially outwards or inwards.

In this manner, a circumferential recess is created on the interior side of the reinforcement ring into which the lip rim of a container to be closed can then be received to snap-fit the cover on the container. The bead can be flattened, for example, and also an appropriately shaped locking element is referred to as a bead.

In a further development of the invention, the peripheral skirt above the cover plate is cylindrical.

The peripheral skirt above the cover plate is an essential element of the multipart cover according to the invention, since by means of the peripheral skirt above the cover plate the cover collar of the base body is fixedly connected to the reinforcement ring. The configuration of said skirt in a cylindrical shape facilitates the production thereof, since the skirt is readily accessible for a pressing tool from both sides. This applies both to the circular skirts and skirts or covers of arbitrary basic shape, for example triangular or rectangular and advantageously with rounded corners.

In a further development of the invention, an inner diameter of the reinforcement ring at the lower rim is greater than an outer diameter of the peripheral skirt above the cover.

In this manner, the reinforcement ring and its lower rim can be placed on the skirt above the cover plate of another cover such that multiple covers may be securely stacked onto another.

In a further development of the invention, the reinforcement ring is enlarged or flaring radially outwards in the region of the lower rim thereof.

Due to the enlargement, there is necessarily a step formed above the enlargement which may then be used as an abutment during stacking of multiple covers, to prevent that multiple stacked covers slide too far onto another and get jammed. The enlargement is configured in the shape of an outwards extending step, for example, to then form an abutment surface for the uppermost rim of the peripheral skirt above the cover plate of the respective lower cover.

In a further development of the invention, the peripheral skirt above the cover plate is configured in the shape of a truncated cone and tapering in a direction away from the cover plate.

In this manner, the stacking of multiple covers is facilitated since the respective upper cover can easily be placed onto the frustoconical tapering peripheral skirt of the respective lower cover.

In a further development of the invention, the reinforcement ring is configured in the shape of a truncated cone in the region of the lower rim thereof, and is enlarged in a direction away from the cover plate, with an inner diameter of the reinforcement ring at the lower rim thereof being greater than an outer diameter of the peripheral skirt at the upper edge.

In this manner, the frustoconical enlarged lower region of the reinforcement ring can be placed accurately fitting onto the frustoconical tapering skirt above the cover plate of the respective lower cover in a simple way such that secure stacking is feasible.

In a further development of the invention, the reinforcement ring below the cover plate is provided with a radially outwards extending, circumferential bead, with an inner diameter of the reinforcement ring at the lower rim thereof being greater than an outer diameter of the reinforcement ring immediately above the bead, and smaller than a greatest outer diameter in the region of the bead.

In this manner, the bead is, on the one hand, an abutment for stacking multiple covers, and on the other hand, an interior side of the outwards extending bead can snap-in on the lip rim of the container during placing onto a container to be closed, and thus ensure secure fitting of the cover on the container.

The problem underlying the invention is also solved by a method for producing a multipart cover made of paper material, comprising the following steps:

shaping a base body from a one-piece paper material cut-out, wherein the base body includes a cover plate and a circumferential cover collar extending from the cover plate, shaping a reinforcement ring including a peripheral skirt which forms a circumferential step along the periphery on a radially interior side of the reinforcement ring, and/or, shaping a reinforcement ring having a circumferential bead, and connecting the reinforcement ring to the base body.

The succession of the method steps can be varied, and the bead can as well be shaped after connecting the reinforcement ring to the base body, for example.

BRIEF DESCRIPTION OF THE DRAWINGS

Further features and advantages of the invention will be apparent from the claims and the subsequent description of preferred embodiments of the invention. Individual features of the different embodiments illustrated in the drawings may be combined in arbitrary manner without departing from the scope of the present invention. In the drawings:

FIG. 21 shows a cover according to another embodiment of the invention in a condition placed on a cup, FIG. 22 shows a sectional view of the cover and the cup of FIG. 21, FIG. 23 shows an enlarged detail of the view of FIG. 22, FIG. 24 shows multiple stacked covers according to FIG. 21, FIG. 25 shows a sectional view of the covers of FIG. 24.

DETAILED DESCRIPTION

Figures 1, 2, 3, 4, 5:
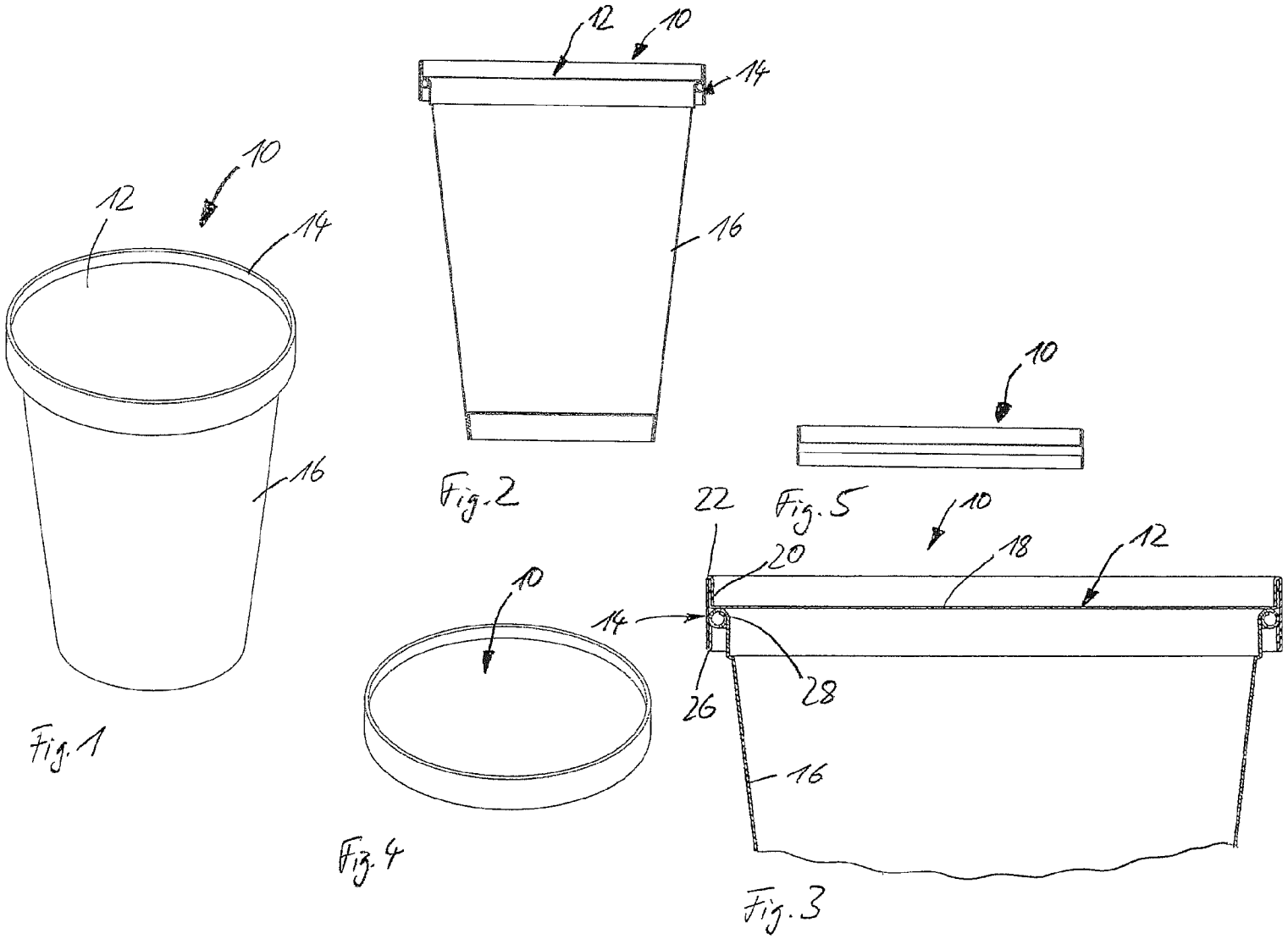
FIG. 1 shows a cover according to a first embodiment of the invention in a condition placed on a paper cup.
FIG. 2 shows a sectional view of the cover and the cup of FIG. 1.
FIG. 3 shows an enlarged detail of the illustration of FIG. 2.
FIG. 4 shows an oblique view from above of the cover of FIG. 1.
FIG. 5 shows a sectional view of the cover of FIG. 1.

The illustration of FIG. 1 shows a cover 10 including a base body 12 and a reinforcement ring 14 connected to the base body 12. The cover 10 is placed onto a paper cup 16.

As can be seen in the FIGS. 2, 3 and 5, the one-piece base body 12 is composed of a cover plate 18 and cover collar 20 at the periphery of the cover plate 18 projecting therefrom perpendicularly upwards. Thus, the base body 12 has a bowl shape open towards the top, that is, open away from the cup 16 to be closed. The reinforcement ring 14 is placed around the periphery of the cover collar 20 and connected to the cover collar 20 by means of a peripheral skirt 22. To achieve this, an upper edge of the reinforcement ring 14 is folded over by 180° such that the cover collar 20 comes to rest within said foldover. The three superimposed material layers are then pressed together, and then, if necessary, sealed on or glued to another to then form the peripheral skirt 22. Said skirt 22 has the shape of a circular cylinder and is disposed at an angle of 90° to the cover plate 18. For pressing the skirt 22, both sides of the skirt 22 are readily accessible for a die or a similar pressing tool.

Below the cover plate 18, the reinforcement ring 14 is initially circular cylindrical as well and is then provided with a peripheral skirt 26. The peripheral skirt 26 at the lower rim of the reinforcement ring 14 is also formed by a foldover of the lower rim by 180° and subsequent pressing, however, the lower skirt 26 is not for connecting to another component, as the upper skirt 22. Instead, the lower skirt 26 and in particular the upper edge of the radially inwards folded material length forms a peripheral step or shoulder, disposed at a constant distance to the cover plate 18. Thereby, a recess is formed between the cover plate 18 and the peripheral step in which a lip rim 28 of the cup 16 may be received sectionally. During sliding on the cover 10 the step at the upper, inner rim of the lower skirt 26 snaps in over the lip rim 28, and thus secures the cover 10 to the lip rim 28 of the cup 16.

The cover 10 according to FIGS. 1 to 5 has a simple construction and can be produced cost efficiently. Both the upper side of the cover plate 18 and the circular cylindrical outer edge of the reinforcement ring 14 may be printed on using simple ways and means.

A bottom side of the cover plate 18, facing the interior of the cup 16 in the placed-on condition, is advantageously coated, for example using synthetic material or wax, to prevent intrusion of moisture or liquid from the interior of the cup 16 into the paper material of the cover plate 18.

In the context of the invention, paper-type materials, like paperboard, pasteboard, cardboard, and the like are considered to be paper materials. Paper materials coated at least on one side are likewise comprised by the expression paper material, for example, paper material coated by synthetic material, in particular hot-sealing synthetic material.

Figure 6:
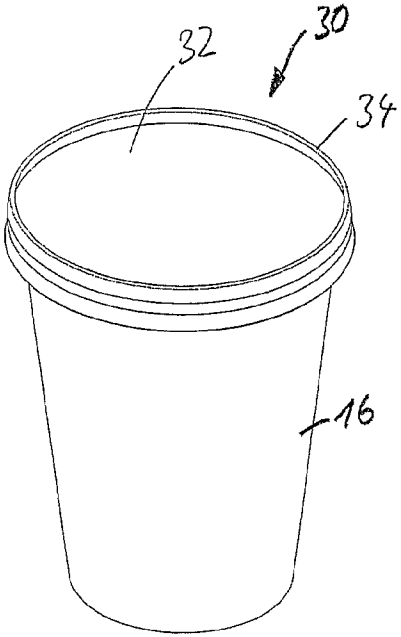
FIG. 6 shows a cover according to the invention according to another embodiment of the invention in a condition placed on a cup.

FIG. 6 shows a cup 30 according to the invention on the cup 16 according to another embodiment. The cover 30 is composed similar to the cover 10 of FIG. 1, and therefore merely the features differing from those of the cover 10 are explained subsequently.

The cover 30 includes a one-piece base body 32 and a reinforcement ring 34 placed around the periphery of the base body 32.

Figure 8:
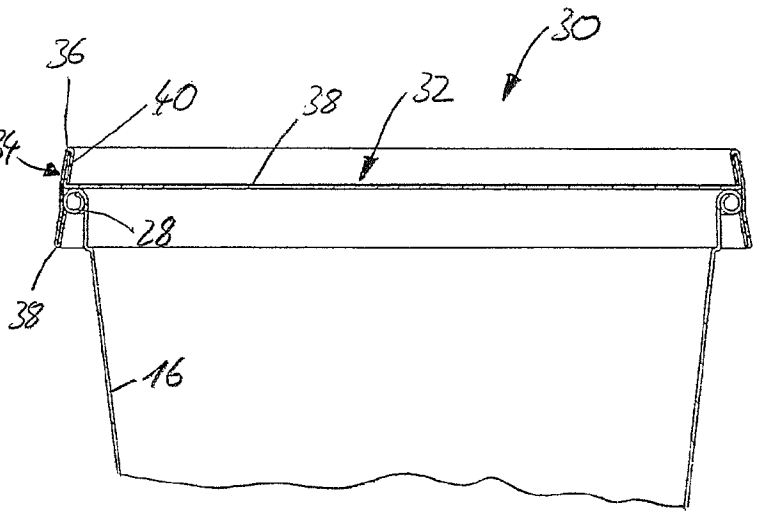
FIG. 8 shows an enlarged detail of the illustration of FIG. 7.
Figure 7:
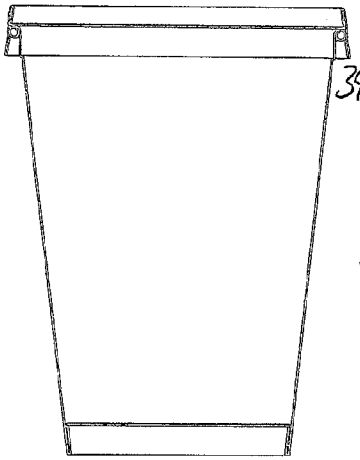
FIG. 7 shows a sectional view of the cover and the cup of FIG. 6.

As can be seen in FIG. 7 and FIG. 8, the base body 12 has a planar cover plate 18 and a cover collar 20 angled away from the cover plate 18. The cover collar 20 includes an angle of less than 90° to the cover plate 18, such that the cover collar 20 has the shape of a tapering truncated cone. The reinforcement ring 34 is connected to the cover collar 20 by means of a peripheral skirt 36 formed by folding over of the upper edge of the reinforcement ring 34 by 180° and accommodation of the cover collar 40 in the thus formed pocket and subsequent pressing. The upper skirt 36 has the shape of a tapering truncated cone, with the outer diameter of the skirt 26 decreasing in a direction away from the cover plate 38.

In a region immediately below the cover plate 37 the reinforcement ring 34 is cylindrical, to then pass over in a lower skirt 38 which is also formed by folding over of the lower rim of the reinforcement ring 34 by 180°. Due to the lower skirt 38, a step is formed which in the placed-on condition of the cover 30 snaps-in below the lip rim 28 of the cup 16, as already explained with reference to FIGS. 1 to 5 and the cover 10. In contrast to the cover 10 of FIGS. 1 to 5, the lower skirt 38 of the reinforcement ring 34 has the shape of a truncated cone, and a diameter of the lower skirt 38 increases in a direction away from the cover plate 37.

Figure 10:
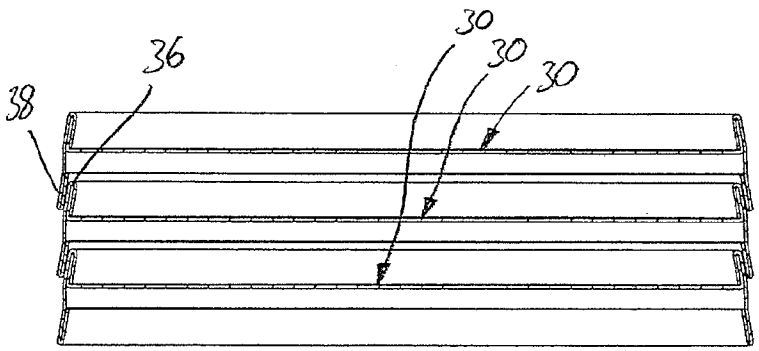
FIG. 10 shows a sectional view of the stacked covers of FIG. 9.
Figure 9:
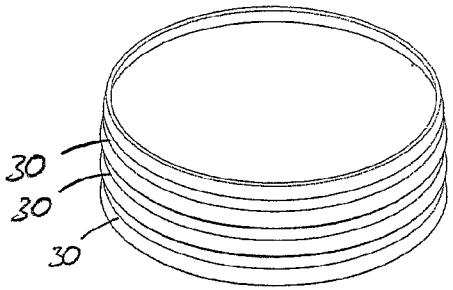
FIG. 9 shows multiple stacked covers according to FIG. 6.

Furthermore, the inner diameter of the lower skirt 38 is selected to be somewhat greater or equal to the outer diameter of the upper skirt 36 such that multiple covers 30 can be stacked onto another, as visible in FIG. 9 and FIG. 10. The lower skirt 38 of a respective upper cover 30 is sitting exterior on the upper skirt 36 of the respective lower cover 30, in the stacked condition of multiple covers 30, see FIG. 10. Therein, the configuration in the shape of a truncated cone, of both the lower skirt 38 and of the upper skirt 36, prevent that multiple stacked covers slide too far onto another and thus get jammed. The configuration in the shape of a truncated cone, of both the lower skirt 38 and of the upper skirt 36, allow stacking even of numerous covers 30, without inducing instability in the developing stack. Still, the covers 30 may be easily and reliably separated therefrom, as explained.

Figure 11:
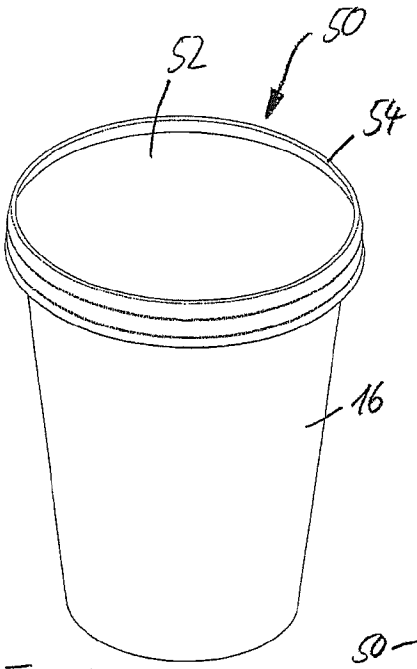
FIG. 11 shows a cover according to the invention according to another embodiment of the invention in a condition placed on a cup.

The illustration of FIG. 11 shows a cover 50 according to the invention according to another embodiment comprising a one-piece base body 52 and a reinforcement ring 54 on the periphery of the base body 52. In FIG. 11, the cover 50 is placed on the cup 16. The cover 50 is composed very similar to the covers 30 of FIGS. 6 to 10 such that merely the components differing from those of the cover 30 are explained.

Figure 13:
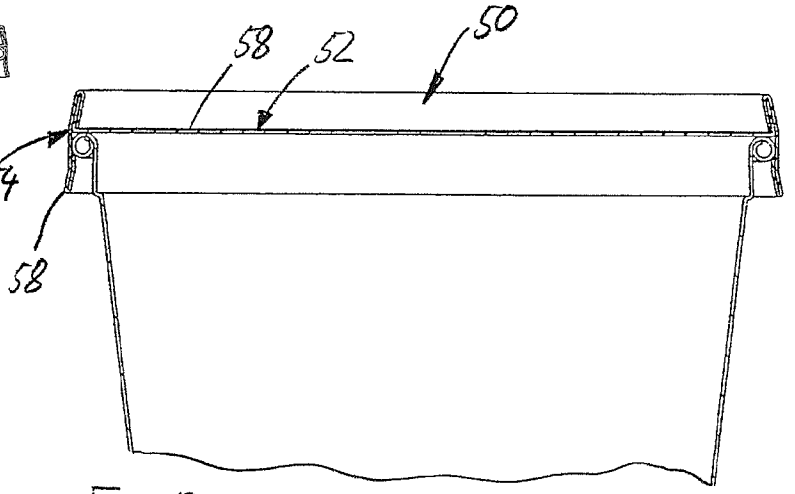
FIG. 13 shows an enlarged detail of the view of FIG. 12.
Figure 12:
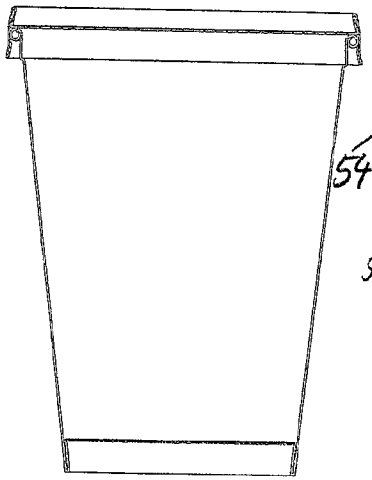
FIG. 12 shows a sectional view of the cover and the cup of FIG. 11.

In particular the base body 52, see FIG. 12 and FIG. 13, are identical to the base body 32 of the cover 30 of FIGS. 6 to 10. The reinforcement ring 54 below the cover plate 57 of the base body 52 is initially circular cylindrical, wherein said circular cylindrical region extends up to the region of the lower skirt 58 on the reinforcement ring 54. Thereby the lower skirt 58 is angled along its extension. Starting from the cover plate 57, the skirt is thus at first circular cylindrical, to then enlarge in a truncated cone shape, until the lowermost rim of the skirt 58 is reached which at the same time also represents the lower rim of the cover 50.

Figure 15:
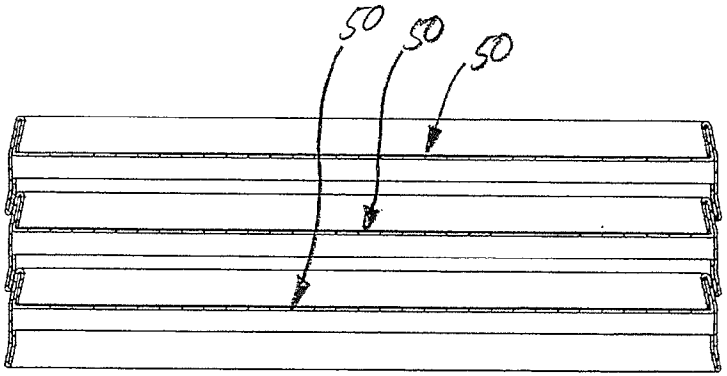
FIG. 15 shows a sectional view of the covers of FIG. 14.
Figure 14:
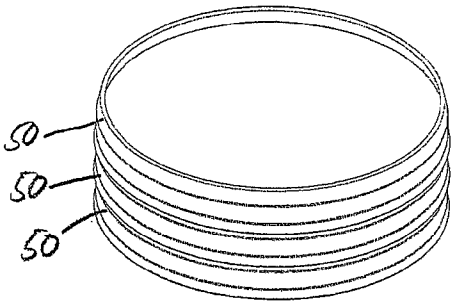
FIG. 14 shows multiple stacked covers according to FIG. 11.

As can be seen in FIG. 14 and FIG. 15, multiple covers 50 can be stacked onto another, wherein the covers 50 can be stacked in a way similar to that of the covers 30 of FIGS. 6 to 10.

Figure 16:
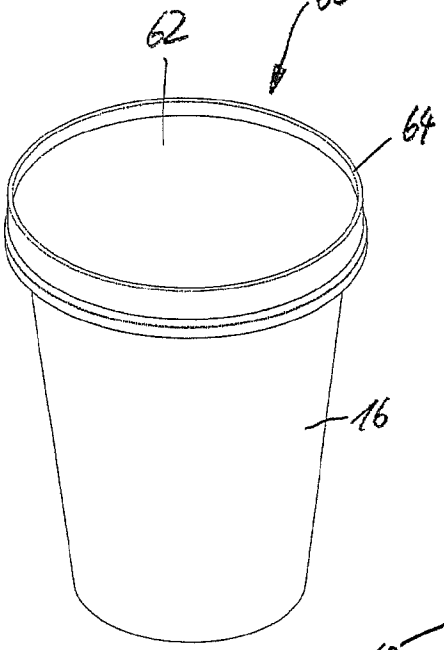
FIG. 16 shows a cover according to the invention according to another embodiment of the invention in a condition placed on a cup.
Figure 28:
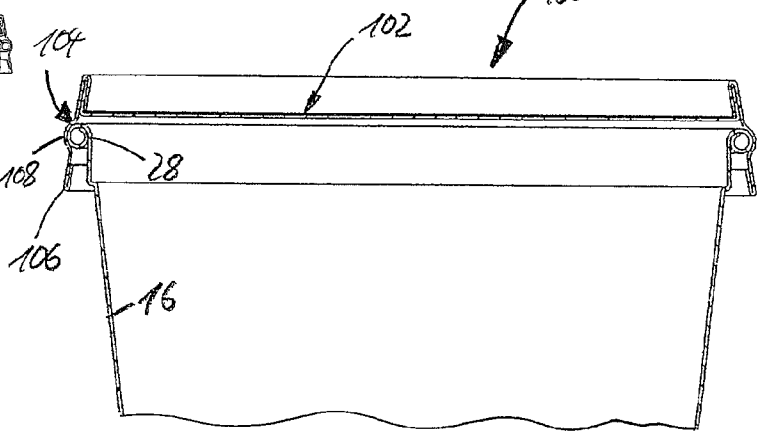
FIG. 28 shows an enlarged detail of the view of FIG. 27.
Figure 27:
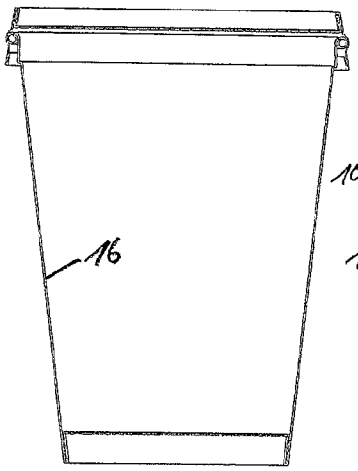
FIG. 27 shows a sectional view of the cover and the cup of FIG. 26.

The illustration of FIG. 16 shows a cover 60 according to the invention according to another embodiment comprising a one-piece base body 62 and a reinforcement ring 64 disposed on the periphery of the base body 62. The cover 60 is placed on the cup 16.

Figure 18:
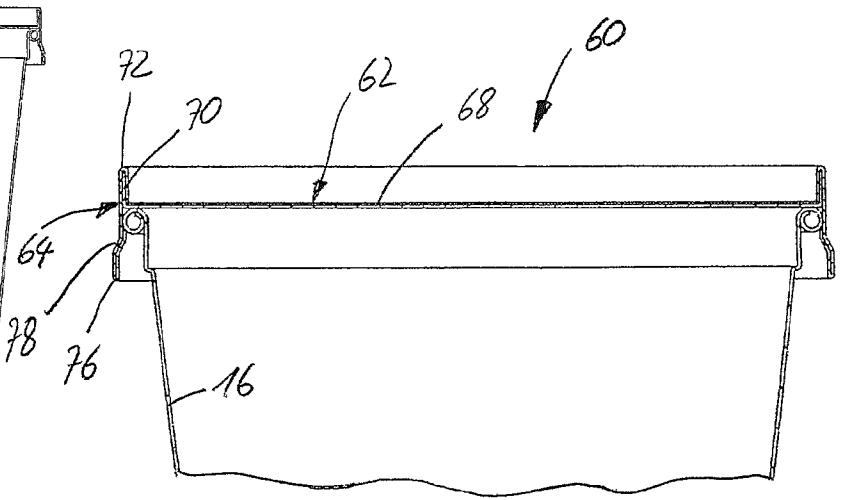
FIG. 18 shows an enlarged detail of FIG. 17.
Figure 17:
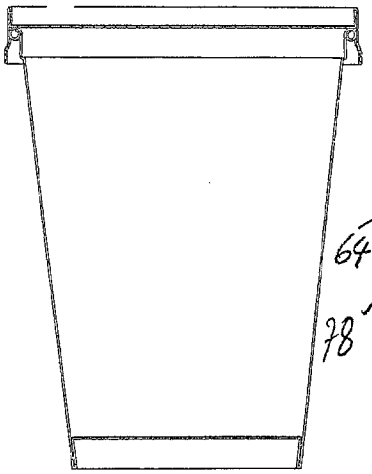
FIG. 17 shows a sectional view of the cover and the cup of FIG. 16.

As can be seen in FIG. 17 and FIG. 18, the base body 62 has a planar cover plate 68 and a cover collar 70 perpendicularly angled away from the cover plate 68. The cover collar 70 is connected to the reinforcement ring 64 by means of an upper peripheral skirt 72. The configuration of the upper skirt 72 and thus the connection to the base body 62 is identical to the cover 10 of FIGS. 1 to 5.

Below the cover plate 68 the reinforcement ring 64 is circular cylindrical and at the lower rim of the reinforcement ring 64 is provided a lower skirt 76. The skirt 76 has an enlargement. Thus, the skirt 76 initially extends, as seen in a direction away from the cover plate 68, in the shape of a circular cylinder, then increases in diameter in the shape of a truncated cone, to then again assume the shape of a circular cylinder up to the lowermost rim of the reinforcement ring 64, but with a greater diameter than immediately adjacent to the cover plate 68. Thereby, the skirt 76 forms a step or shoulder adapted to, on the one hand, facilitate sliding the cover 60 onto the cup 16, and on the other hand, provide for a very feasible stacking of multiple covers 60.

Figure 20:
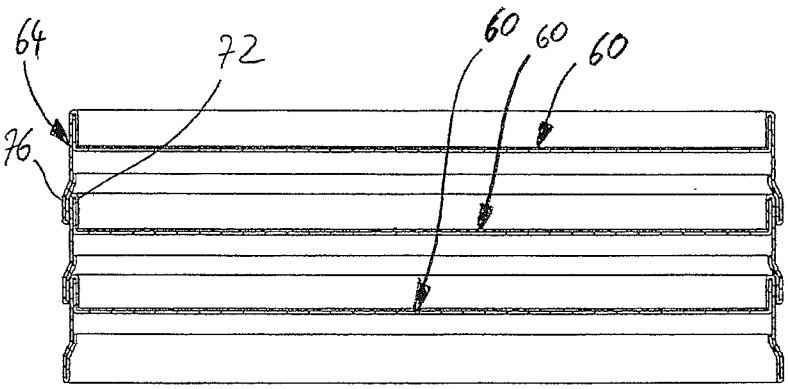
FIG. 20 shows a sectional view of the covers of FIG. 19.
Figure 19:
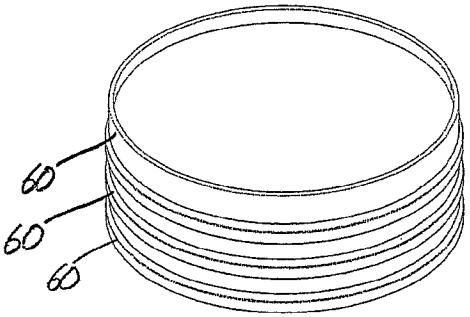
FIG. 19 shows multiple stacked covers according to FIG. 16.

As can be seen in FIG. 20, an inner diameter of the lower skirt 67 in the lowermost, circular cylindrical region thereof, is to a minor extent greater or equal to an outer diameter of the circular cylindrical upper skirt 72. Thereby, a cover having the lower skirt 76 can be slid onto the upper skirt 72 of a lower cover, until the upper rim of the upper skirt 72 abuts the step formed by the frustoconical enlargement along the extension of the lower skirt 76 of the upper cover 60. Thus, said step on the interior side of the lower skirt 76 of the reinforcement ring 64 prevents that the respective upper cover 60 slides too far onto the respective lower cover 60 and the covers thereby get jammed. Instead, the step 78 along the lower skirt 76 of the reinforcement ring 64 defines a step for the upper skirt 72 of the respective lower cover during stacking of multiple covers 60.

The illustration of FIG. 21 shows a cover 80 according to the invention according to another embodiment of the invention comprising a one-piece base body 82 and a reinforcement ring 84 on the periphery of the base body 82. The cover 80 is placed on the cup 16.

As can be seen in FIGS. 22 and 23, the base body 82 has a planar cover plate 88 and a cover collar 90 angled away from the cover plate 88. The cover collar 90 includes an angle of less than 90 degrees of angle to the cover plate 88. The cover collar 90 is connected to the reinforcement ring 84 by means of a peripheral upper skirt 92, said skirt exhibiting a shape of a truncated cone tapering away from the cover plate 88.

Immediately below the cover plate 88 the reinforcement ring 84 includes a circumferential, radially outwards extending bead 86, in the shape of a circle segment, and matched to the outer diameter of the lip rim 28 of the cup 16. Below the bead 86 the reinforcement ring 84 is in the shape of a truncated cone, wherein a diameter of the reinforcement ring 84 below the bead 86 enlarges in a direction away from the cover plate 88.

Thus, the cover 80 can be slid onto the lip rim 28 in a simple manner, and the reinforcement ring 84 enlarges due to said sliding on procedure, until the lip rim 28 snaps into the bead 86, and the cover 80 is thereby fixed on the cup 16.

As can be seen in FIGS. 24 and 25, the bead 86 and the upper side thereof serve as a stop during stacking of multiple covers 80. The lowermost rim of the reinforcement ring 84 of an upper cover 80 rests on the upper side of the bead 86 of the respective lower cover 80. Thereby the bead 86 prevents that the respective upper cover 80 slides too far onto the respective lower cover 80 and the covers 80 in the stacked condition get jammed.

Figure 26:
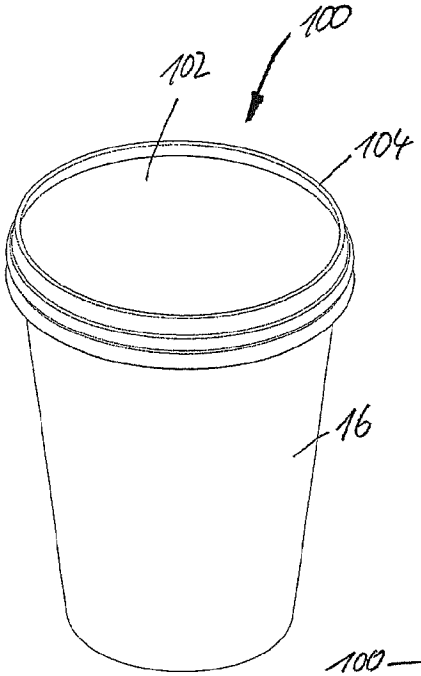
FIG. 26 shows a cover according to the invention according to another embodiment of the invention in a condition placed on a cup.

The illustration of FIG. 26 shows a cover 100 according to another embodiment of the invention comprising a one-piece base body 102 and a reinforcement ring 104 on the periphery of the base body 102. The cover 100 is placed on the cup 16.

The cover 100 is essentially identical to the cover 80 of FIGS. 21 to 25, and therefore merely the features differing from those of the cover 80 are explained.

In contrast to the cover 80, the reinforcement ring 104 is provided with a lower skirt 106 at the lower rim thereof, said skirt formed by folding over the lower rim of the reinforcement ring 104 by 180 degrees of angle and subsequent pressing. In a region below the radially outwards extending bead 108 the reinforcement ring 104 is in the shape of a truncated cone, and also in the region of the lower skirt 106. Therein, a diameter of the lower skirt 106 enlarges in a direction away from the base body 102 and the cover plate thereof, respectively. Due to the lower skirt 106, a step is formed below the bead 108 and projecting inwards. During placing the cover 100 onto the cup 16, at first the upper rim of the lower skirt 106 snaps in behind the lip rim 28 of the cup 16, and is thereby already secured on the cup 16. When the cover 100 is then further pushed in the direction towards the cup, the lip rim 28 snaps into the circumferential bead 108, in order to thereby fix the cover 100 in a particularly secure manner on the cup 16.

Figure 30:
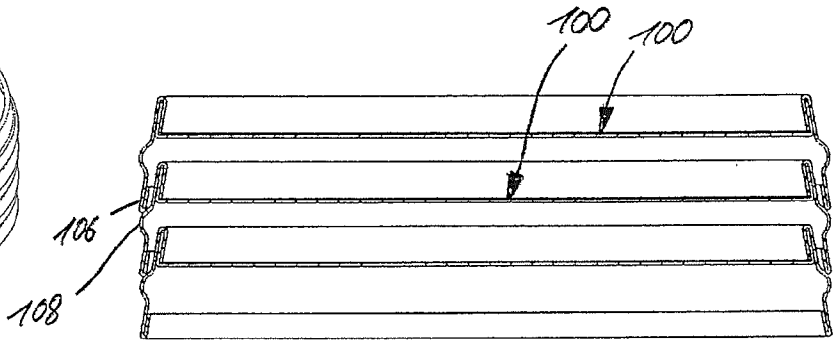
FIG. 30 shows a sectional view of the covers of FIG. 29.
Figure 29:
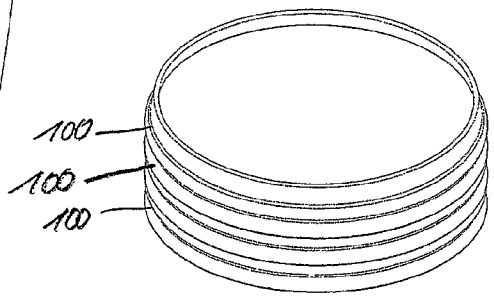
FIG. 29 shows multiple stacked covers according to FIG. 26.

In the illustrations of FIG. 29 and FIG. 30 is shown that in the stacked condition of multiple covers 100 the respective lowermost rim of the lower skirt 106 of an upper cover 100 rests on the upper side of the bead 108 of a respective lower cover 100. Said interaction of the lower skirt 106 of the respective upper cover and the bead 108 of the respective lower cover 100 thus prevent that the covers 100 slide too far onto another during stacking and get jammed.

The illustrations of FIGS. 31 to 35 show a cover 130 according to the invention placed on the cover 16 and differing from the cover 100 illustrated in FIGS. 26 to 30 merely in minor features.

Therefore, the individual components of the cover 130 according to the invention will not be explained again, and reference is made merely to the differences to the cover 100 of FIGS. 26 to 30.

In contrast to the cover 100, see FIG. 30, the radially outwards extending bead 138 is disposed to a minor extent closer to the cover plate of the base body 132 of the cover 130 according to the invention. After the cover 130 is placed on the cup 16 and the lip rim 28 of the cup has snapped into the bead 138 from the inside, as a result, the outer rim of the cover plate of the base body 132 rests on top of the lip rim 28.

Figure 33:
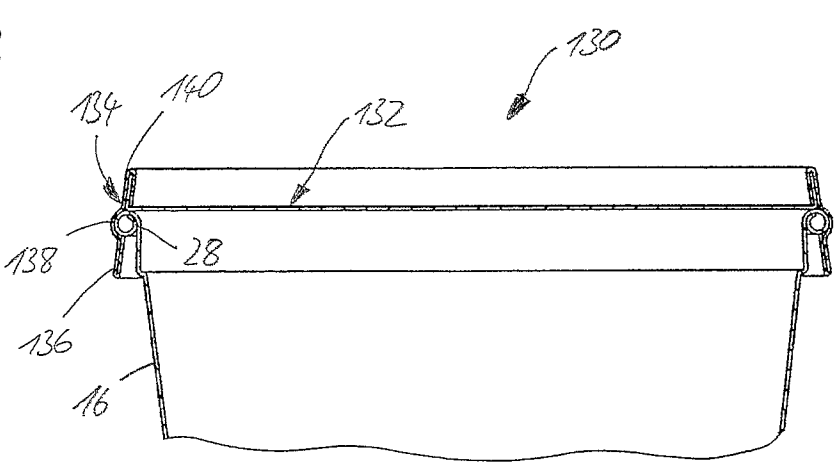
FIG. 33 shows an enlarged detail of the view of FIG. 32.
Figure 32:
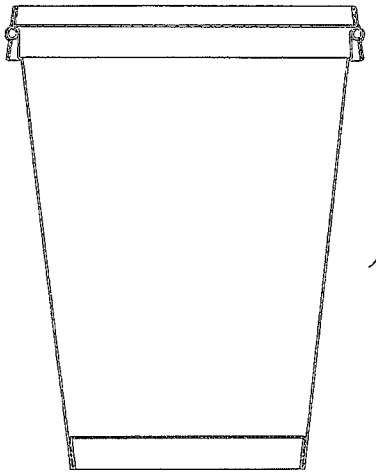
FIG. 32 shows a sectional view of the cover and the cup of FIG. 31.
Figure 35:
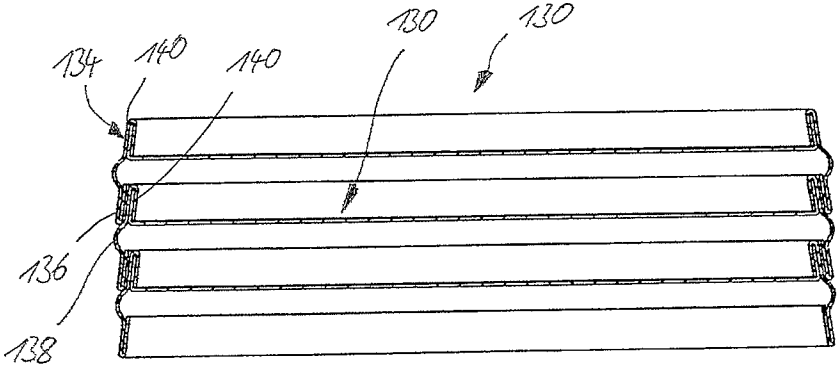
FIG. 35 shows a sectional view of the covers of FIG. 34.
Figure 34:
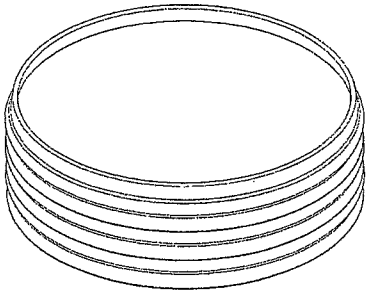
FIG. 34 shows multiple stacked covers according to FIG. 31.
Figure 31:
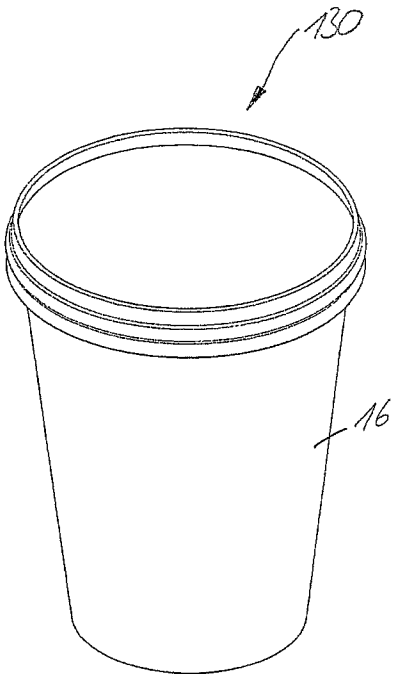
FIG. 31 shows a cover according to the invention according to another embodiment of the invention in a condition placed on a cup.
Figure 38:
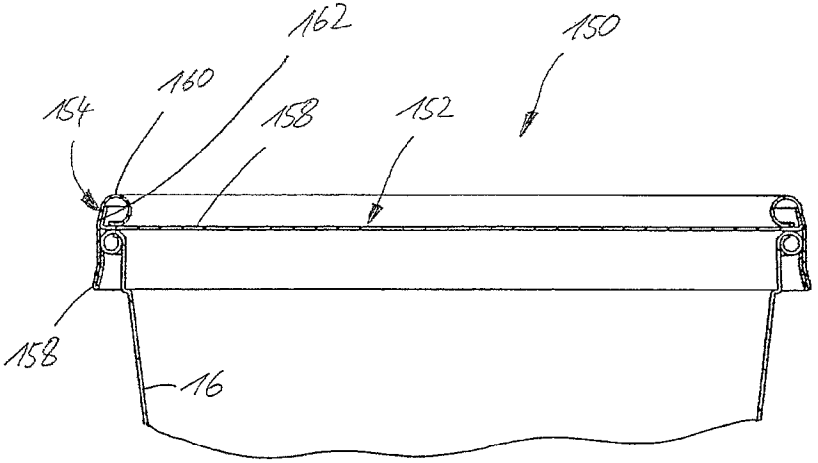
FIG. 38 shows an enlarged detail of the view of FIG. 37.
Figure 40:
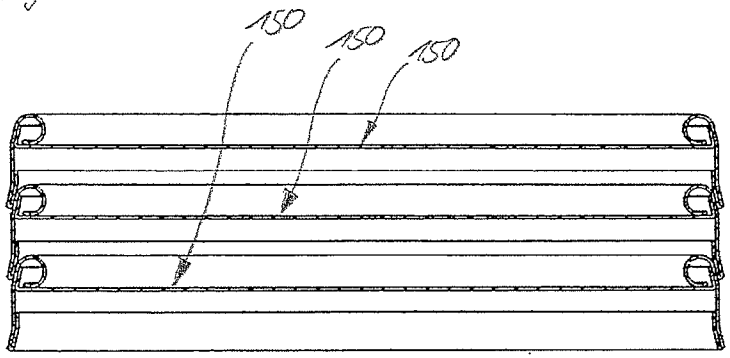
FIG. 40 shows a sectional view of the covers of FIG. 39.
Figure 37:
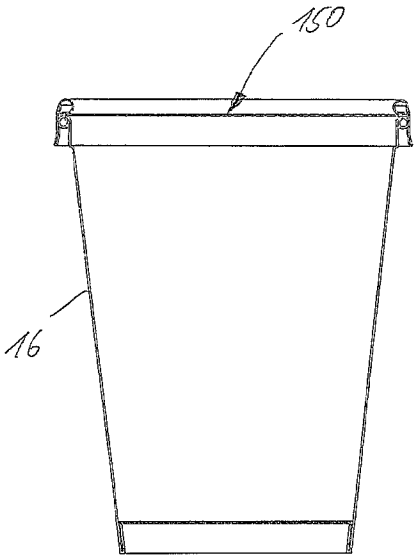
FIG. 37 shows a sectional view of the cover and the cup of FIG. 36.
Figure 39:
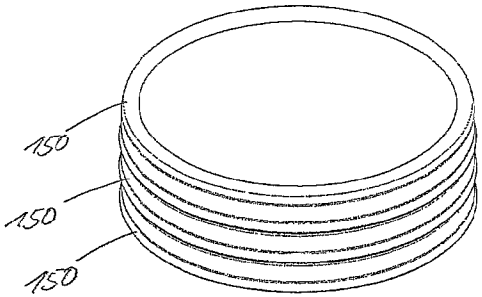
FIG. 39 shows multiple stacked covers according to FIG. 36.
Figure 36:
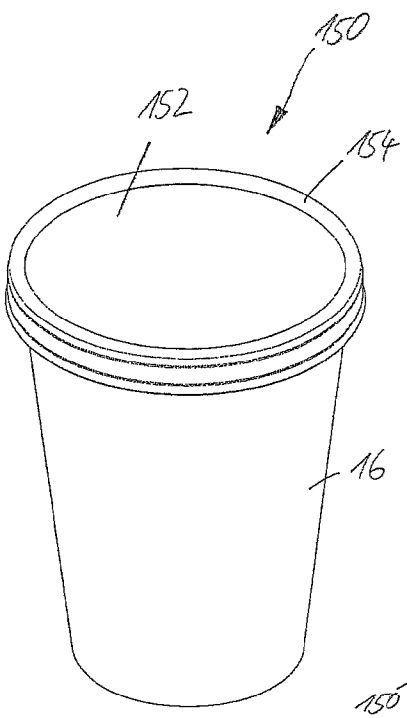
FIG. 36 shows a cover according to the invention according to another embodiment of the invention in a condition placed on a cup.
Figure 43:
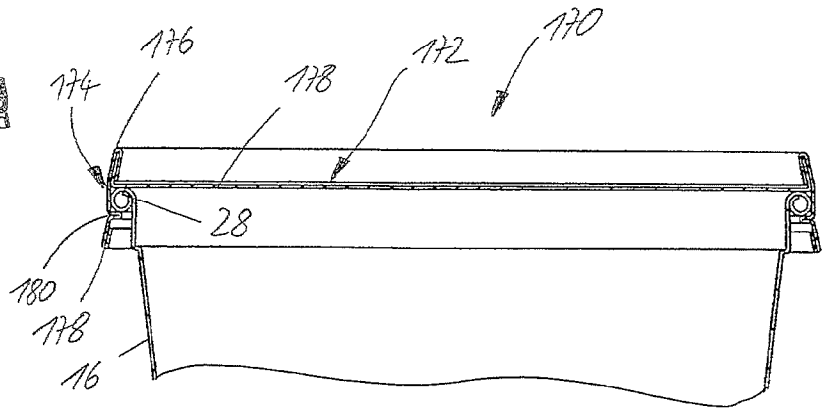
FIG. 43 shows an enlarged detail of the view of FIG. 42.

Furthermore, in contrast to the cover 100 of FIGS. 26 to 30, the lower skirt 136 of the cover 130 has minor differences of configuration in that, indeed, the lower rim is also folded over, but has an extension to the top far enough that in the placed-on condition of the cover 130, see FIG. 33, said rim rests on the bottom side of the lip rim 28. The undercut formed by the bead 138 is thereby enlarged and the cover 130 sits particularly tight on the cup 16.

Another difference between the covers 100 and 130 is in the fact that an upper skirt 140 of the cover 130, on which skirt the base body 132 and the reinforcement ring 134 are interconnected, has an outer diameter corresponding essentially to the inner diameter of the lower skirt 136 of the reinforcement ring 134. In the stacked condition of multiple covers, see FIG. 35, the interior side of the lower skirt 136 of a respective upper cover 130 rests on the exterior side of the upper skirt 140 of the respective lower cover 130. Movement of the respective upper cover 130 during stacking in the direction to the respective lower cover 130 is stopped by the abutment of the lower rim of the lower skirt 136 of the respective upper cover 130 on the upper side of the bead 138 of the respective lower cover 130.

The illustrations of FIGS. 36 to 40 show another embodiment of a cover 150 according to the invention. The cover 150 is similar to the cover 50 of FIGS. 11 to 15, and therefore the individual components of the cover 150 will not be explained again, but instead reference will be made to the features differing to those of cover 50 of FIGS. 11 to 15.

Instead of an upper skirt the cover 150 has a ring roll 160 formed on the upper rim of a reinforcement ring 154. In the sectional view of FIG. 38, the ring roll 160 describes a curve of 270° starting from the exterior rim of the reinforcement ring 154, and the end of the roll rests on a cover plate 157 of a base body 152 of the cover 150 essentially in parallel. At the exterior edge, the cover plate 157 passes into a cover collar 162, said collar turning away from the cup 16 by somewhat more than 90° and with the exterior peripheral surface resting on an interior side of the reinforcement ring 154. The cover collar 162 is connected to the cover collar 154, for example by adhesive bonding or sealing. The end of the ring roll 160 can also be connected to the cover plate 157, but the end of the ring roll 160 can also rest on the cover plate 157 unfixed.

The lower skirt 158 of the reinforcement ring 154 does not differ from the lower skirt 58 of the cover 50 of FIGS. 11 to 15.

The illustrations of FIGS. 41 to 45 show another embodiment of a cover 170 according to the invention. The cover 170 is similar to the cover 50 of FIGS. 11 to 15, and therefore the individual components of the cover 170 will not be explained again, but instead reference will be made to the components differing from those of cover 50 of FIGS. 11 to 15.

In contrast to the cover 50 of FIGS. 11 to 15, on a reinforcement ring 174 the cover 170 has a flattened bead 180 extending radially inwards. Said flattened bead 180 forms a protrusion projecting inwards and arranged such that there is a distance between a bottom side of a planar cover plate 177 of the bowl-shaped base body 172 and an upper side of the bead 180, said distance corresponding essentially to the height of the lip rim 28 of the cup 16. Thus, when placing the cover 170 onto the cup 16, at first the portion of the reinforcement ring 174 located below the cover plate 177 is enlarged radially outwards, until the flattened bead 180 snaps below the lip rim 28 and then simultaneously a bottom side of the cover plate 177 rests on an upper side of the lip rim 28. Thereby, the cover 170 is fixed to the lip rim 28 of the cup 16 in a particularly secure manner.

An upper skirt 176, used to connect the reinforcement ring 174 and the base body 172, is identical to the cover 50 of FIGS. 11 to 15. A lower skirt 178 of the reinforcement ring 174 is formed by a foldover by 180° of the lower rim of the reinforcement ring 174 and enlarged in a cone shape, in order to facilitate placing onto the lip rim 28 of the cup 16.

Figure 45:
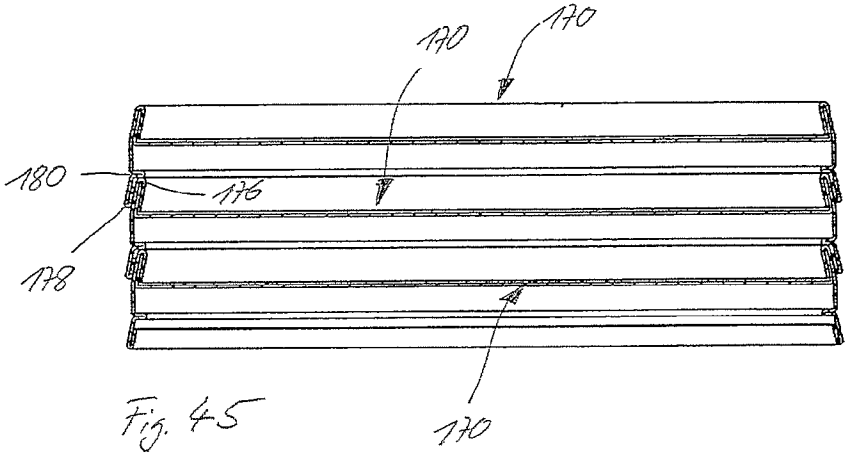
FIG. 45 shows a sectional view of the covers of FIG. 44.
Figure 42:
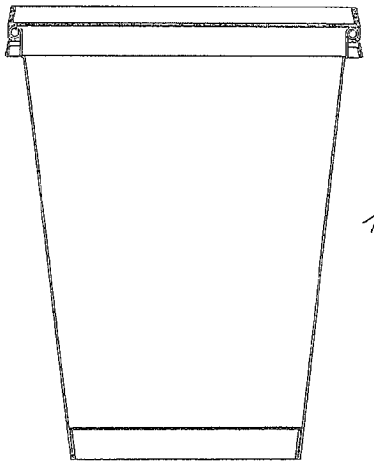
FIG. 42 shows a sectional view of the cover and the cup of FIG. 41.
Figure 44:
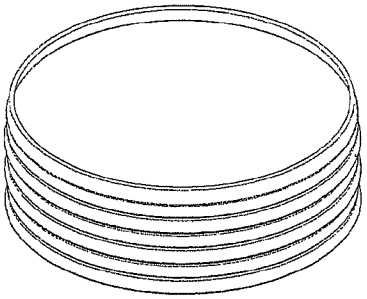
FIG. 44 shows multiple stacked covers according to FIG. 41.
Figure 41:
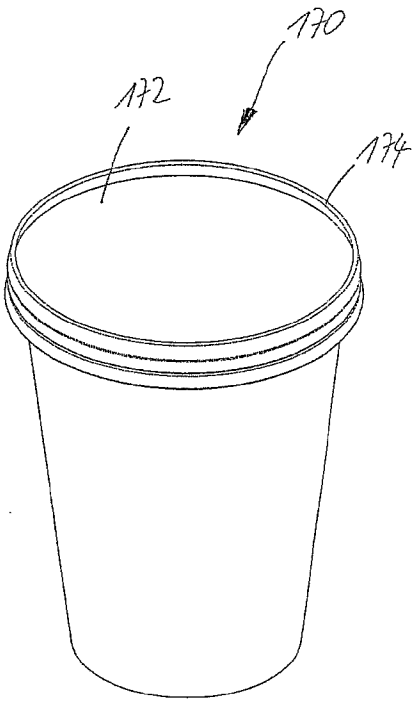
FIG. 41 shows a cover according to the invention according to another embodiment of the invention in a condition placed on a cup.

In the stacked condition of multiple cups, see FIGS. 44 and 45, a respective upper cover 170 is with the bottom side of the flattened bead 180 sitting on the upper rim of the skirt 176 of the respective lower cover 170. During stacking of multiple covers 170, this is to prevent that the covers slide too far into another and thereby get jammed. An inner diameter of the lower skirt 178 of the respective upper cover 170 is resting on an exterior side of the upper skirt 176 of the respective lower cover 170. By that means, multiple covers 170 are sitting securely onto another in the stacked condition.

Figure 46:
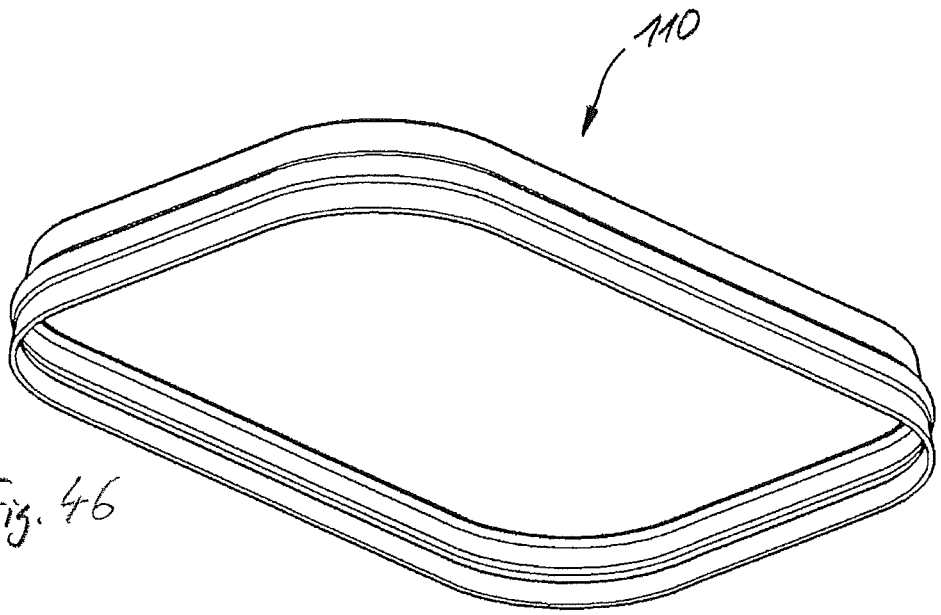
FIG. 46 shows a cover according to another embodiment of the invention in an oblique view from below.
Figure 47:
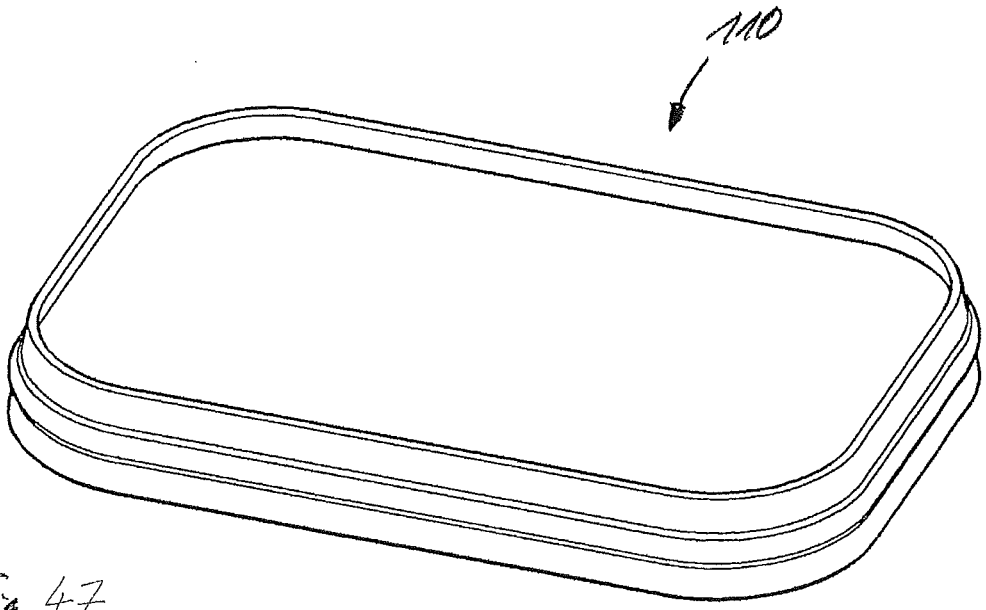
FIG. 47 shows an oblique view from above of the cover of FIG. 46.

The illustration of FIG. 46 shows a cover 110 according to the invention in an oblique view from below according to another embodiment of the invention, and FIG. 47 shows the cover 110 in an oblique view from above. With the exception of the rectangular basic shape of the cover 110, said cover is similar to the cover 100 of FIGS. 26 to 30, and therefore the configuration will not be explained again. Multiple covers 110 may be stacked and the corners of the rectangular basic shape are in each case rounded. Said feature is to facilitate the configuration of the upper peripheral skirt used to connect the base body to the reinforcement ring of the cover 110. An important fact is that said rectangular basic shape with rounded corners can be realized even on a cup, and in particular in the configuration of a lip rim on the upper edge of such a cup having a rectangular basic shape.

Figure 48:
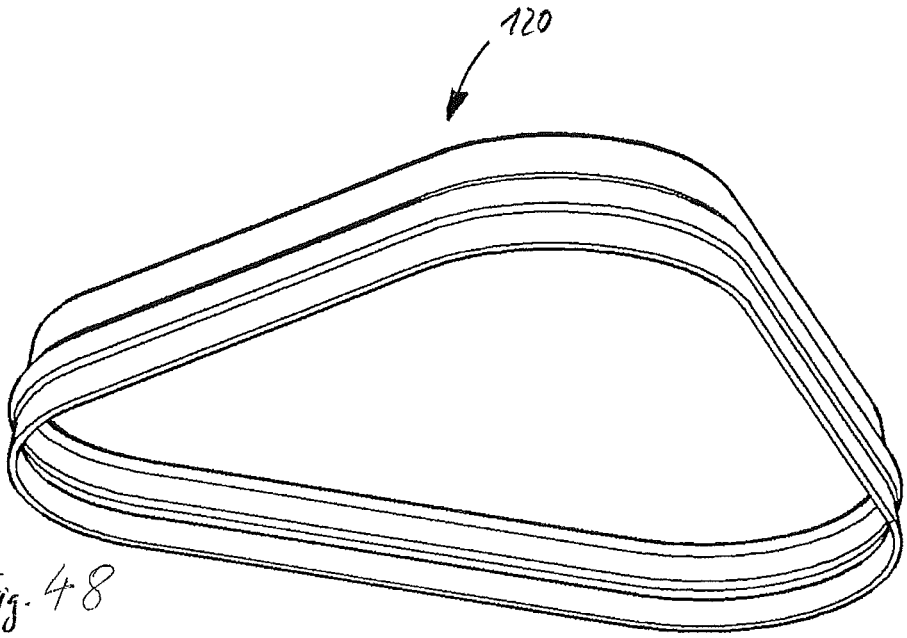
FIG. 48 shows a cover according to the invention according to another embodiment of the invention in an oblique view from below.
Figure 49:
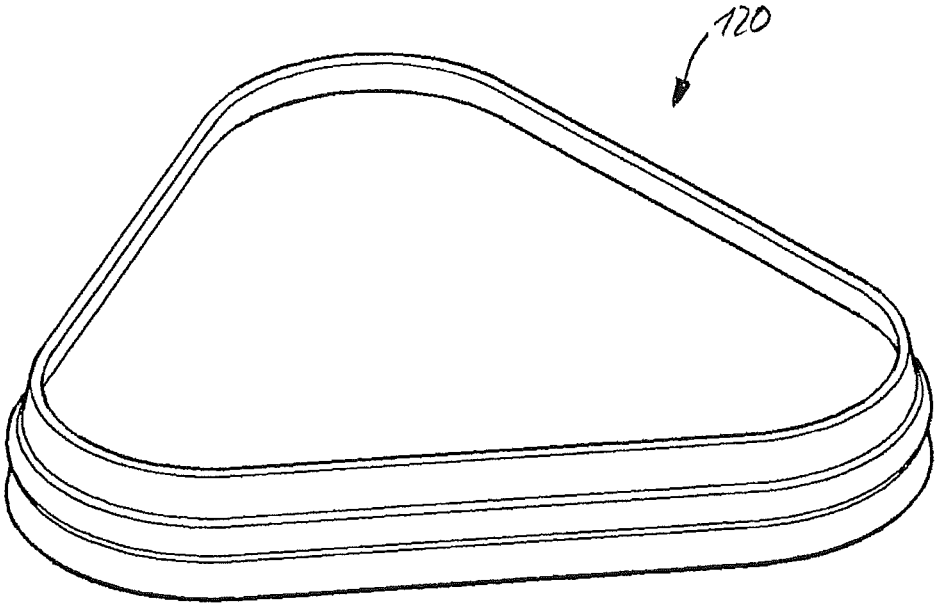
FIG. 49 shows an oblique view from above of the cover of FIG. 48.

The illustration of FIG. 48 shows a cover 120 according to another embodiment of the invention in an oblique view from below, and FIG. 49 shows the cover 120 in an oblique view from above. With the exception of the triangular basic shape, said cover 120 of FIGS. 48 and 49 is similar to the cover 110 of FIGS. 46 and 47, and therefore also similar to the cover 100 of FIGS. 26 to 30. Just like those covers, multiple of the covers 120 may be stacked. The corners of the triangular basic shape are rounded.

For producing a multipart cover according to the invention made of paper material, at first a base body is shaped from a one-piece paper material cut-out, wherein the base body is given a bowl shape including a cover plate and a circumferential cover collar extending from the cover plate. Furthermore, a reinforcement ring is shaped from a strip made of paper material by sectionally overlapping of the strip and connecting it in the region of the overlapping. The reinforcement ring is provided with a peripheral skirt, said skirt forming a circumferential step or shoulder along the periphery on a radial interior side of the reinforcement ring, and/or the reinforcement ring is provided with a circumferential bead. The circumferential step and/or the circumferential bead are to create a defined position of the cover during placing onto a cup having a lip rim, in that the step will snap in behind the lip rim of the cup or the lip rim will snap into the bead or behind the bead. Due to the circumferential step or the bead, a defined position of the cover on the cup is created, and still the cover may be removed from the cup without destruction. The lip rim of the cup, as viewed in cross section, can be circular or even be oval by flattening of a lip rim.

The reinforcement ring is connected to the base body by means of a peripheral skirt, wherein said skirt, connecting the base body to the reinforcement ring, is arranged above the cover plate, that is, on a side of the cover plate of the base body facing away from the container to be closed.

The invention claimed is:

1. A multipart cover made of paper material comprising a one-piece base body including a cover plate and a circumferential cover collar extending from the cover plate, wherein the cover collar, in a condition placed onto a container to be closed, extends upwards away from the container, and a reinforcement ring connected to the cover collar by a peripheral shroud, wherein the reinforcement ring in a region below the cover plate, that is, on a side of the cover plate opposite to the cover collar, includes a peripheral skirt forming a circumferential bead along a periphery thereof, wherein the reinforcement ring widens in a region of a lower rim thereof at least below the bead, thereby exhibiting an angle oblique to a middle axis of the cover and wherein the reinforcement ring is enlarged in a direction away from the cover plate, wherein an inner diameter of the reinforcement ring at a lower terminal rim edge is greater than an outer diameter of the peripheral skirt at an upper rim thereof, wherein the region of the reinforcement ring that is enlarged ends at a free end edge at the lower rim of the reinforcement ring such that the reinforcement ring tapers and is flared outwardly from at least below the bead to the free end edge of the lower rim of the reinforcement ring, wherein the bead extends radially outwards, wherein an inner diameter of the reinforcement ring at the lower rim is greater than an outer diameter of the reinforcement ring above the cover plate, and wherein a vertical height of the reinforcement ring is at least three times smaller than a horizontal diameter of the cover plate.

2. The multipart cover according to claim 1, wherein the reinforcement ring above the cover plate is cylindrical.

3. The multipart cover according to claim 1, wherein the reinforcement ring above the cover plate is in the shape of a truncated cone and tapers in a direction away from the cover plate.

4. The multipart cover according to claim 1, wherein the reinforcement ring is in the shape of a truncated cone in the region of the lower rim thereof.

5. The multipart cover according to claim 1, wherein the entire reinforcement ring except for the bead forms a frusto-conical surface, and the bead extends radially outwardly from the frusto-conical surface.

6. A multipart cover made of paper material comprising a one-piece base body including a cover plate and a circumferential cover collar extending from the cover plate, wherein the cover collar, in a condition placed onto a container to be closed, extends upwards away from the container, and a reinforcement ring connected to the cover collar by a peripheral shroud, wherein the reinforcement ring in a region below the cover plate, that is, on a side of the cover plate opposite to the cover collar, includes a peripheral skirt forming a circumferential step along a periphery thereof on a radially interior side of the reinforcement ring, and/or a circumferential bead along the periphery, wherein the reinforcement ring widens in a region of a lower rim thereof at least below the step or bead, thereby exhibiting an angle oblique to a middle axis of the cover and wherein the reinforcement ring is enlarged in a direction away from the cover plate, wherein an inner diameter of the reinforcement ring at a lower terminal rim edge is greater than an outer diameter of the peripheral skirt at an upper rim, wherein the region of the reinforcement ring that is enlarged ends at a free end edge at the lower rim of the reinforcement ring such that the reinforcement ring tapers and is flared outwardly from at least below the step or bead to the free end edge of the lower rim of the reinforcement ring, wherein the reinforcement ring below the cover plate is provided with a radially outwardly extending, circumferential bead, wherein the inner diameter of the reinforcement ring at the lower rim edge thereof is greater than an outer diameter of the reinforcement ring immediately above the bead, and smaller than a greatest outer diameter in a region of the bead.

7. A method for producing a multipart cover made of paper material, comprising the following steps:

shaping a base body from a one-piece paper material cut-out, wherein the base body includes a cover plate and a circumferential cover collar extending from the cover plate;

shaping a reinforcement ring including a peripheral skirt which forms a circumferential bead; and connecting the reinforcement ring to the base body;

wherein the reinforcement ring widens in a region of a lower rim thereof at least below the bead, thereby exhibiting an angle oblique to a middle axis of the cover and wherein the reinforcement ring is enlarged in a direction away from the cover plate, wherein an inner diameter of the reinforcement ring at a lower terminal rim edge is greater than an outer diameter of the peripheral skirt at an upper rim, wherein the region of the reinforcement ring that is enlarged ends at a free end edge at the lower rim of the reinforcement ring such that the reinforcement ring tapers and is flared outwardly from at least below the bead to the free end edge of the lower rim of the reinforcement ring;

wherein the bead extends radially outwards;

wherein an inner diameter of the reinforcement ring at the lower rim is greater than an outer diameter of the reinforcement ring above the cover plate; and wherein a vertical height of the reinforcement ring is at least three times smaller than a horizontal diameter of the cover plate.

8. The method according to claim 7, wherein the entire reinforcement ring except for the bead forms a frusto-conical surface, and the bead extends radially outwardly from the frusto-conical surface.

9. A multipart cover comprising:

a one-piece paper base body including a cover plate and a circumferential cover collar extending upwardly from the cover plate, with the cover collar extending upwards away from a container to be closed when placed onto the container; and a paper reinforcement ring connected to the cover collar and extending downwardly below the cover plate when the base body is connected to the container;

the paper reinforcement ring including a peripheral skirt below the cover plate on a side of the cover plate opposite to the cover collar, the peripheral skirt including a circumferential bead along an external periphery thereof on a radially exterior side of the peripheral skirt of the paper reinforcement ring;

the peripheral skirt of the paper reinforcement ring flaring outwardly to widen in a region of a lower rim at least below the bead, with the paper reinforcement ring being enlarged in a direction away from the cover plate such that an inner diameter of the peripheral skirt at a lower terminal rim edge is greater than an outer diameter of the peripheral skirt at an upper rim, and with the peripheral skirt flaring outwardly at the lower terminal rim edge;

wherein the bead extends radially outwards;

wherein an inner diameter of the reinforcement ring at the lower rim is greater than an outer diameter of the reinforcement ring above the cover plate; and wherein a vertical height of the reinforcement ring is at least three times smaller than a horizontal diameter of the cover plate.

10. The multipart cover according to claim 9, wherein the reinforcement ring above the cover plate is cylindrical.

11. The multipart cover according to claim 9, wherein the reinforcement ring above the cover plate is in the shape of a truncated cone and tapers in a direction away from the cover plate.

12. The multipart cover according to claim 9, wherein the reinforcement ring is in the shape of a truncated cone in the region of the lower rim thereof.

13. The multipart cover according to claim 9, wherein an inner diameter of the reinforcement ring at the lower rim thereof is greater than an outer diameter of the reinforcement ring immediately above the bead, and smaller than a greatest outer diameter in a region of the bead.

14. The multipart cover according to claim 9, wherein the entire reinforcement ring except for the bead forms a frusto-conical surface, and the bead extends radially outwardly from the frusto-conical surface.

* * * * *